US009159275B2

(12) United States Patent
Kimura

(10) Patent No.: US 9,159,275 B2
(45) Date of Patent: Oct. 13, 2015

(54) DISPLAY DEVICE AND DRIVING METHOD THEREOF

(75) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 284 days.

(21) Appl. No.: 13/166,463

(22) Filed: Jun. 22, 2011

(65) Prior Publication Data

US 2011/0316820 A1 Dec. 29, 2011

(30) Foreign Application Priority Data

Jun. 25, 2010 (JP) ..... 2010-144865

(51) Int. Cl.
*G09G 3/34* (2006.01)

(52) U.S. Cl.
CPC ..... *G09G 3/344* (2013.01); *G09G 2230/00* (2013.01); *G09G 2310/061* (2013.01); *G09G 2320/0257* (2013.01); *G09G 2380/14* (2013.01)

(58) Field of Classification Search
CPC ..... G09G 3/3433–3/348; G09G 2310/068; G09G 3/344–3/3446
USPC ..... 345/107
See application file for complete search history.

(56) References Cited

U.S. PATENT DOCUMENTS 6,650,462 B2 11/2003 Katase
6,774,884 B2 8/2004 Shimoda et al.
6,987,503 B2 1/2006 Inoue
7,019,889 B2 3/2006 Katase
7,027,074 B2 4/2006 Koyama
7,324,123 B2 1/2008 Yamazaki et al.
7,330,169 B2 2/2008 Koyama
7,336,249 B2 2/2008 Hirakata et al.
7,359,110 B2 4/2008 Katase
7,502,039 B2 3/2009 Koyama et al.
8,102,363 B2 1/2012 Hirayama
2006/0139304 A1* 6/2006 Goden ..... 345/107
2006/0262081 A1* 11/2006 Zhou et al. ..... 345/107
2006/0279525 A1* 12/2006 Matsuda ..... 345/107
2007/0212022 A1* 9/2007 Zhou et al. ..... 386/94
2008/0143668 A1* 6/2008 Shin et al. ..... 345/107
2008/0150886 A1* 6/2008 Johnson et al. ..... 345/107
2008/0231592 A1* 9/2008 Johnson et al. ..... 345/107
2008/0238867 A1* 10/2008 Maeda et al. ..... 345/107
2008/0273132 A1 11/2008 Hsu et al.
2009/0058797 A1* 3/2009 Hirayama ..... 345/107

(Continued)

FOREIGN PATENT DOCUMENTS

JP 2007-206266 A 8/2007
JP 2007-206471 8/2007

(Continued)

*Primary Examiner* — Sanghyuk Park
(74) *Attorney, Agent, or Firm* — Husch Blackwell LLP

(57) ABSTRACT

A method for reducing afterimages in a device for displaying images by application of an electric field to a charged substance is provided. A plurality of pixels each include a display element including a pixel electrode, a charged layer, and a counter electrode. The display device has a function of applying different potentials to pixel electrodes that are adjacent to each other in a period during which the pixels are initialized. Thus, electric fields are generated not only in a direction perpendicular to the pixel electrodes but also in a direction parallel to the pixel electrodes (the end-face direction of the pixel electrodes), so that charged substances in the charged layer stir. Accordingly, aggregation can be prevented.

20 Claims, 11 Drawing Sheets

(56) References Cited

U.S. PATENT DOCUMENTS

| | | | | |
|---|---|---|---|---|
| 2010/0231579 | A1* | 9/2010 | Kanbayashi et al. | 345/214 |
| 2010/0265168 | A1* | 10/2010 | Neugebauer | 345/87 |
| 2011/0063339 | A1 | 3/2011 | Umezaki et al. | |
| 2011/0063340 | A1 | 3/2011 | Umezaki et al. | |
| 2012/0113083 | A1* | 5/2012 | Kim et al. | 345/212 |

FOREIGN PATENT DOCUMENTS

| | | |
|---|---|---|
| JP | 2008-276153 | 11/2008 |
| JP | 2009-058645 A | 3/2009 |

* cited by examiner

DISPLAY DEVICE AND DRIVING METHOD THEREOF

BACKGROUND OF THE INVENTION

1. Field of the Invention

The technical field of the present invention relates to a display device and a method for driving a display device. Further, the technical field of the present invention relates to a method for manufacturing a display device.

2. Description of the Related Art

These days, with the development of digitization techniques, text data and image data of newspapers, magazines, and the like can be provided as electronic data. This kind of electronic data is generally displayed on a display device included in a television, a personal computer, a portable electronic terminal, or the like, so that the content of the data can be read.

As display devices with high visibility equivalent to the visibility of paper, display devices using electronic ink have been developed. As a display device using electronic ink, for example, there is a display device which includes a microcapsule between a pixel electrode and a counter electrode. In such a display device, images are displayed by application of voltage between the two electrodes and movement of colored particles in the microcapsule in an electric field direction (see Reference 1).

REFERENCE

Reference 1: Japanese Published Patent Application No. 2008-276153

SUMMARY OF THE INVENTION

In Reference 1, there has been a problem in that afterimages are generated when display images are switched.

One of the causes of the problem is that electric fields are only applied in a direction perpendicular to pixel electrodes 5003 and a counter electrode 5005 in a display element 5001 and particles 5007 only move in the perpendicular direction as illustrated in FIG. 11. Accordingly, aggregation of the particles 5007 occurs, so that afterimages are generated.

In view of the problem, it is an object to improve the performance of a display device, for example, to reduce afterimages.

A display device disclosed in this specification is a device for displaying images by application of an electric field to a charged substance. The display device includes a plurality of pixels and has a function of applying different potentials to pixel electrodes that are adjacent to each other in a period during which the pixels are initialized (such a function is also referred to as a processing mode). Thus, electric fields are applied to the charged substance not only in a direction perpendicular to the pixel electrodes but also in a direction parallel to the pixel electrodes (also referred to as the end-face direction of the pixel electrodes), so that aggregation can be reduced. Note that the perpendicular direction and the parallel direction are a direction perpendicular to an upper surface of the pixel electrode and a direction parallel to the upper surface of the pixel electrode, respectively.

One embodiment of the present invention is a display device which includes a plurality of pixels. The plurality of pixels each include a display element including a pixel electrode, a counter electrode, and a charged layer (also referred to as a layer including a charged substance) provided between the pixel electrode and the counter electrode. The display device has a function of applying different potentials to one pixel electrode and a pixel electrode which is adjacent to the one pixel electrode in a period during which the plurality of pixels are initialized.

Another embodiment of the present invention is a display device which includes a plurality of pixels. The plurality of pixels each include a display element including a pixel electrode, a counter electrode, and a charged layer provided between the pixel electrode and the counter electrode. The display device has a function of inverting the levels of the potentials of one pixel electrode and a pixel electrode which is adjacent to the one pixel electrode after different potentials are applied to the one pixel electrode and the pixel electrode which is adjacent to the one pixel electrode in a period during which the plurality of pixels are initialized.

Another embodiment of the present invention is a display device which includes a plurality of pixels. The plurality of pixels each include a display element including a pixel electrode, a counter electrode, and a charged layer provided between the pixel electrode and the counter electrode. The display device has a function of applying potentials whose polarities are different from each other with the potential of the counter electrode as a reference to one pixel electrode and a pixel electrode which is adjacent to the one pixel electrode in a period during which the plurality of pixels are initialized.

Another embodiment of the present invention is a display device which includes a plurality of pixels. The plurality of pixels each include a display element including a pixel electrode, a counter electrode, and a charged layer provided between the pixel electrode and the counter electrode. The display device has a function of inverting the polarities of the potentials of one pixel electrode and a pixel electrode which is adjacent to the one pixel electrode with the potential of the counter electrode as a reference after potentials whose polarities are different from each other with the potential of the counter electrode as a reference are applied to the one pixel electrode and the pixel electrode which is adjacent to the one pixel electrode in a period during which the plurality of pixels are initialized.

Another embodiment of the present invention is a display device which includes a plurality of pixels. The plurality of pixels each include a display element including a pixel electrode, a counter electrode, and a charged layer provided between the pixel electrode and the counter electrode. The display device has a function of performing initialization with a combination of dot inversion and line inversion in a period during which the plurality of pixels are initialized.

Another embodiment of the present invention is a display device which includes a plurality of pixels. The plurality of pixels each include a display element including a pixel electrode, a counter electrode, and a charged layer provided between the pixel electrode and the counter electrode. The display device has a function of performing initialization with a combination of dot inversion, line inversion, processing for displaying a black image on the entire screen, and processing for displaying a white image on the entire screen in a period during which the plurality of pixels are initialized. Note that in this specification, a function of performing initialization or inversion is also referred to as a processing mode.

Thus, it is possible to improve the performance of a display device, for example, to reduce afterimages.

DETAILED DESCRIPTION OF THE INVENTION

Figure 1A:
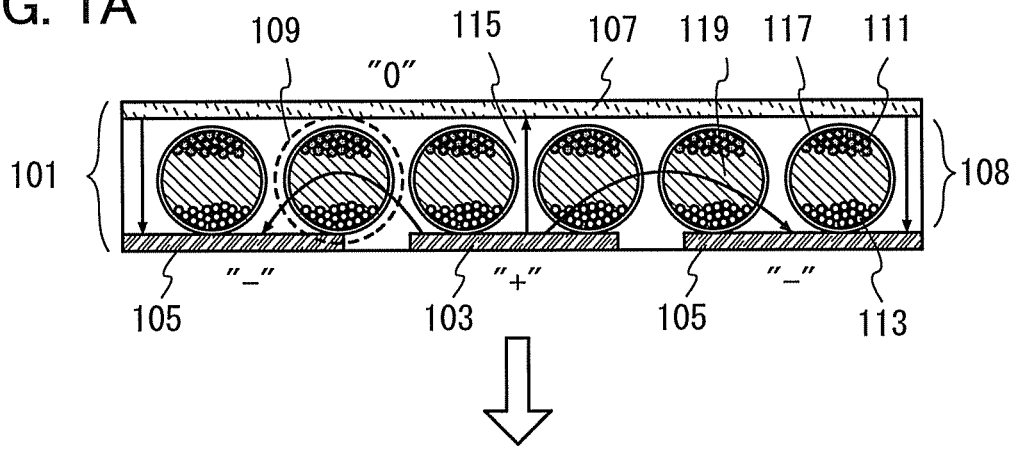
FIGS. 1A and 1B illustrate an example of a structure of a display device.

Embodiments will be described in detail below with reference to the drawings. Note that the embodiments can be implemented in various different ways. It will be readily appreciated by those skilled in the art that modes and details of the embodiments can be modified in various ways without departing from the spirit and scope of the present invention. The present invention therefore should not be construed as being limited to the following description of the embodiments. In all the drawings for describing the embodiments, the same portions or portions having similar functions are denoted by the same reference numerals, and description thereof is not repeated.

Embodiment 1

In this embodiment, an example of initialization of a pixel in a display device is described.

Figure 1B:
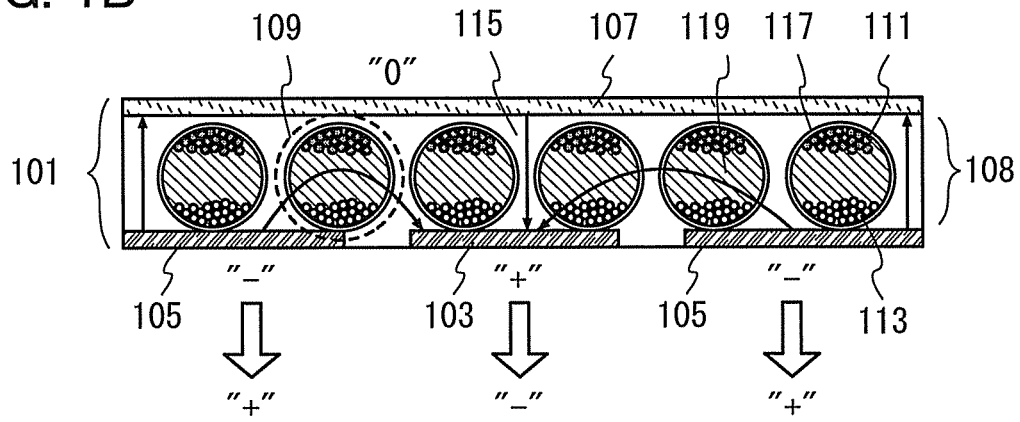

FIGS. 1A and 1B are cross-sectional views of a pixel portion, which each illustrate three pixels. One pixel includes a display element 101 which includes a pixel electrode 103, a counter electrode 107, and a charged layer 108 (also referred to as a layer including a charged substance) provided between the pixel electrode 103 and the counter electrode 107. A pixel that is adjacent to the one pixel includes the display element 101 which includes a pixel electrode 105, the counter electrode 107, and the charged layer 108.

The charged layer 108 includes a plurality of microcapsules 109. The microcapsule 109 includes colored particles 111 and 113. The colored particles 111 and 113 function as charged substances.

Arrows in FIGS. 1A and 1B indicate directions in which electric fields are generated at the time when voltage is applied to the display elements 101.

A display device in one embodiment of the present invention has a function of applying different potentials to the pixel electrode 103 in one pixel and the pixel electrode 105 in a pixel that is adjacent to the pixel in a period during which the pixels are initialized.

For example, as illustrated in FIG. 1A, a "+" potential (also referred to as an H-level potential or a positive potential) is applied to the pixel electrode 103, and a "−" potential (also referred to as an L-level potential or a negative potential) is applied to the pixel electrode 105.

In that case, a reference potential (e.g., 0 V) may be applied to the counter electrode 107. That is, in this example, potentials whose polarities are different from each other with the potential of the counter electrode 107 as a reference are applied to the pixel electrode 103 and the pixel electrode 105. Note that the counter electrode 107 may be used in common in the pixels, or the counter electrodes 107 may be provided separately in the pixels. When the counter electrode 107 is used in common in the pixels, manufacture and input of potentials are facilitated.

By such application of different potentials to pixel electrodes that are adjacent to each other, electric fields can be generated not only in a direction perpendicular to the pixel electrodes but also in a direction parallel to the pixel electrodes (the end-face direction of the pixel electrodes). That is, the electric fields have components in the end-face direction of the pixel electrodes. Consequently, the particles 111 and 113 move and stir in the direction perpendicular to the pixel electrodes and the direction parallel to the pixel electrodes. Thus, aggregation of the particles 111 and 113 can be reduced.

Further, the display device has a function of inverting the polarity of a potential applied to each pixel electrode with the potential of the counter electrode 107 as a reference after the potentials are applied to the pixel electrodes as described above.

Specifically, after the potentials are applied to the pixel electrodes as described above, as in FIG. 1B, a "−" potential is applied to the pixel electrode 103 and a "+" potential is applied to the adjacent pixel electrode 105. That is, the polarity of the potential is inverted from "−" to "+" or from "+" to "−". In other words, the potential of the pixel electrode is inverted with the potential of the counter electrode 107 as the reference.

By such inversion of the polarity of an applied potential, the aggregation of the particles 111 and 113 can be further reduced.

Note that a predetermined interval may be set before the polarity of a potential is inverted.

In addition, the pixel portion may be divided into several regions and the polarity of a potential may be inverted in each region.

Note that the polarity of a potential may be inverted more than once. When the polarity of a potential is inverted more than once, the effect of preventing aggregation of the particles 111 and 113 can be improved.

Note that although initialization is performed with the potential of the counter electrode 107 as the reference in FIGS. 1A and 1B, this embodiment is not limited to this. When different potentials are applied to the pixel electrode 103 and the pixel electrode 105, electric fields can be generated in a direction parallel to the pixel electrodes. For example, a "+" potential may be applied to the pixel electrode 103 and 0 V may be applied to the pixel electrode 105. Then, electric fields in a reverse direction can be generated when the levels of the potential of the pixel electrode 103 and the potential of the pixel electrode 105 are interchanged with each other. For example, 0 V is applied to the pixel electrode 103 and a "+" potential is applied to the pixel electrode 105.

When the display device has a function of inputting video signals after pixels are initialized as described above, display in which afterimages are reduced can be performed.

The charged layer 108 is described in detail below.

The charged layer 108 includes the plurality of microcapsules 109 and a resin 115. The microcapsules 109 are dispersed in and fixed to the resin 115. The resin 115 functions as a binder.

The resin 115 preferably has light-transmitting properties. Instead of the resin 115, the charged layer 108 may be filled with a gas such as air or an inert gas. In that case, a layer or layers containing an adhesive or the like may be formed on either one or both the pixel electrode 103 and the counter electrode 107 so that the microcapsules 109 are fixed.

The microcapsule 109 includes a film 117, a liquid 119, the particle 111, and the particle 113. The liquid 119, the particle 111, and the particle 113 are encapsulated in the film 117. The film 117 has light-transmitting properties. The cross-sectional shape of the microcapsule 109 is not limited to a round shape, and may be an elliptical shape or an uneven shape.

The liquid 119 functions as a dispersion liquid. The liquid 119 can disperse the particle 111 and the particle 113 in the film 117. Note that it is preferable that the liquid 119 have light-transmitting properties and be non-tinted.

The particle 111 and the particle 113 have different colors. For example, one of the particle 111 and the particle 113 may be black and the other of the particle 111 and the particle 113 may be white. Note that the particle 111 and the particle 113 are charged so as to have different electrical charge densities, and function as charged substances. For example, one of the particle 111 and the particle 113 may be charged positively and the other of the particle 111 and the particle 113 may be charged negatively. Thus, a potential difference is generated between the pixel electrode 103 and the counter electrode 107, and the particle 111 and the particle 113 move in accordance with the direction of an electric field. Accordingly, the reflectance of the display element 101 is changed, so that gradation can be controlled.

Note that the structure of the microcapsule 109 is not limited to the above structure. For example, the liquid 119 may be colored. In addition, the colors of the particles can be selected from red, green, blue, cyan, magenta, yellow, emerald green, vermillion, or the like in addition to white and black. Further, the colors of the particles may be one kind of color or three or more kinds of colors.

Further, the mode of the display element 101 is not limited to a microcapsule type. A microcup type, horizontal movement, vertical movement, a twisting ball (e.g., a spherical twisting ball or a cylindrical twisting ball), powder movement, electronic liquid powder (registered trademark), a charged toner, electro wetting, electrochromism, electrodeposition, or the like can be used. The display element 101 corresponds to all the elements that can be used for image display by movement of charged substances such as particles included in the charged layer 108.

Note that in the case where a display image is viewed from the counter electrode 107 side, the counter electrode 107 is formed using a light-transmitting material. As the light-transmitting material, it is possible to use, for example, indium tin oxide (ITO), indium tin oxide containing silicon oxide (ITSO), organoindium, organotin, zinc oxide (ZnO), indium zinc oxide (IZO), zinc oxide containing gallium, tin oxide ($SnO_2$), indium oxide containing tungsten oxide, indium zinc oxide containing tungsten oxide, indium oxide containing titanium oxide, or indium tin oxide containing titanium oxide.

In that case, the pixel electrode 103 can be formed using the light-transmitting material or a metal material. In particular, the pixel electrode 103 is preferably formed using a metal material whose reflectance of visible light is low or a metal material whose absorptance of visible light is high. When the pixel electrode 103 is formed using such a material, reflectance on the pixel electrode 103 does not easily occur; thus, visibility of the display image is improved. As a metal whose reflectance is low, for example, chromium or the like can be used.

Alternatively, the display image may be viewed from the pixel electrode 103 side. In that case, the pixel electrode 103 is formed using the light-transmitting material.

In that case, the counter electrode 107 is preferably formed using a metal whose reflectance is lower than the reflectance of the metal used for the pixel electrode 103. The counter electrode 107 can be formed using the metal whose reflectance is low.

Alternatively, the display image may be viewed from the counter electrode 107 side and the pixel electrode 103 side. In that case, the counter electrode 107 and the pixel electrode 103 are formed using the light-transmitting material. In order to prevent light from shining through opposite sides, polarizing plates are preferably provided on the counter electrode 107 side and the pixel electrode 103 side in crossed nicols.

When the initialization is performed on the pixel in which the display element is provided, display in which afterimages are reduced can be performed.

This embodiment can be combined with any of the other embodiments as appropriate.

Embodiment 2

In this embodiment, the initialization of the pixel that is described in Embodiment 1 is specifically described.

FIGS. 2A to 2F are top views of the pixel portion, where potentials are applied to 25 (5×5) pixel electrodes.

Figure 2A:
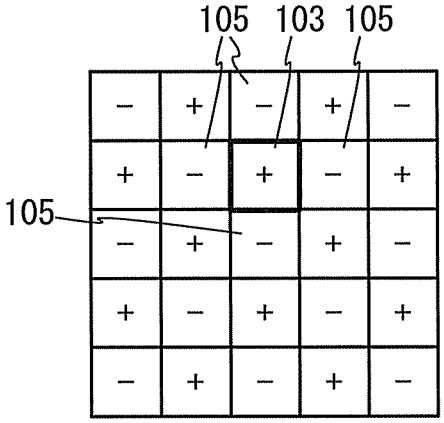
FIGS. 2A to 2F illustrate examples of a driving method of a display device.

In an example in FIG. 2A, a "+" potential is applied to one pixel electrode 103 and a "−" potential is applied to all the pixel electrodes 105 that are adjacent to the one pixel electrode 103. When potentials whose polarities are different from each other are applied to pixel electrodes that are adjacent to each other so that pixels are initialized in this manner, electric fields are also generated in a direction parallel to the pixel electrodes. Thus, aggregation of particles can be reduced.

Figure 2B:
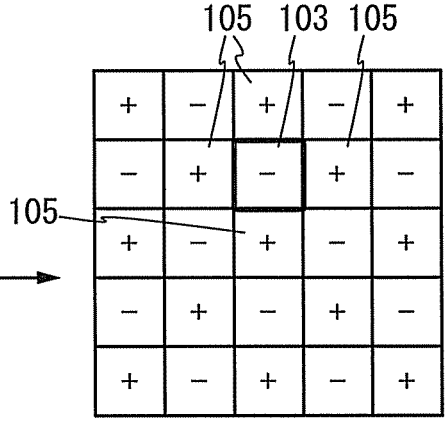

In addition, after the potentials are applied as in FIG. 2A, a "−" potential may be applied to the one pixel electrode 103 and a "+" potential may be applied to all the pixel electrodes 105 that are adjacent to the one pixel electrode 103 as in FIG. 2B. That is, the polarities of the potentials applied to the pixel electrodes are inverted. By such inversion of the polarities of applied potentials, the aggregation of the particles can be further reduced.

Figure 2C:
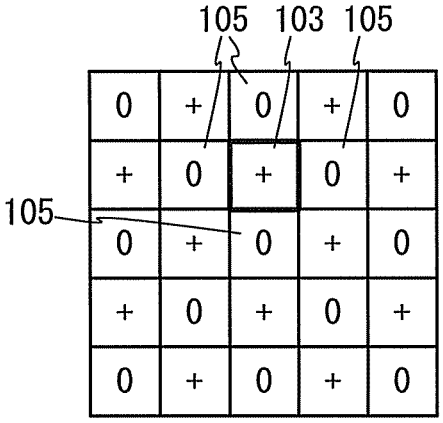

In an example in FIG. 2C, 0 V is applied instead of the "−" potential in FIG. 2A, so that electric fields are generated between the pixel electrodes 103 to which a "+" potential is applied and the pixel electrodes 105 to which 0 V is applied. Thus, electric fields are also generated in a direction parallel to the pixel electrodes, so that the aggregation of the particles can be reduced.

Figure 2D:
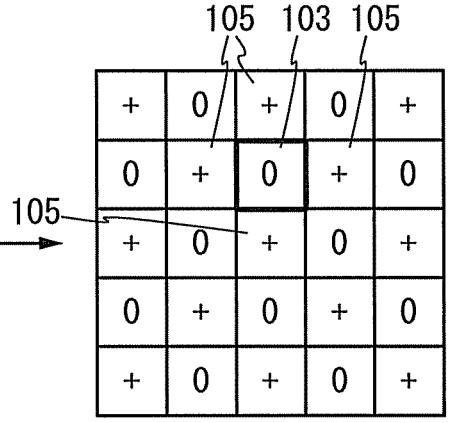

In addition, after the potentials are applied as in FIG. 2C, 0 V may be applied to the one pixel electrode 103 and a "+" potential may be applied to all the pixel electrodes 105 that are adjacent to the one pixel electrode 103 as in FIG. 2D. That is, the levels of the potentials are inverted. By such inversion of 0 V and the "+" potential, the aggregation of the particles can be further reduced.

Figure 2E:
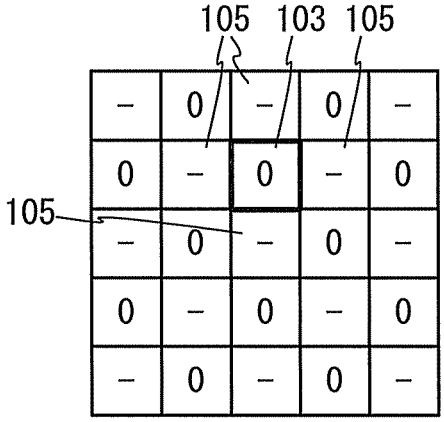

In an example in FIG. 2E, 0 V is applied instead of the "+" potential in FIG. 2A, so that electric fields are generated between the pixel electrodes 103 to which 0 V is applied and the pixel electrodes 105 to which a "−" potential is applied. Thus, electric fields are also generated in a direction parallel to the pixel electrodes, so that the aggregation of the particles can be reduced.

Figure 2F:
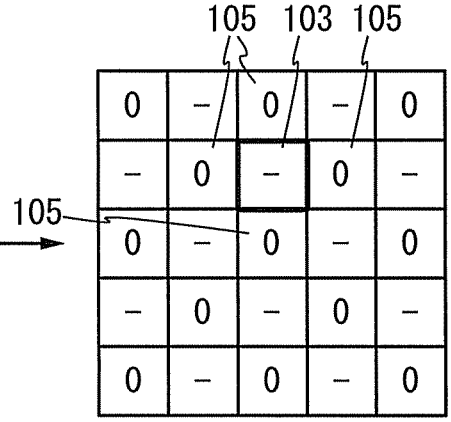

In addition, after the potentials are applied as in FIG. 2E, a "−" potential may be applied to the one pixel electrode 103 and 0 V may be applied to all the pixel electrodes 105 that are adjacent to the one pixel electrode 103 as in FIG. 2F. That is, the levels of the potentials are inverted. By such inversion of 0 V and the "−" potential, the aggregation of the particles can be further reduced.

As described above, in FIGS. 2A to 2F, initialization is performed in each pixel (in each dot). Thus, in the case where inversion is performed, the inversion is also referred to as dot inversion. The initialization may be performed by plural dot inversions.

When the display device has a function of inputting video signals to pixel electrodes after pixels are initialized as described above, display in which afterimages are reduced can be performed.

This embodiment can be combined with any of the other embodiments as appropriate.

Embodiment 3

In this embodiment, a specific example of initialization of pixels that is different from the example in Embodiment 2 is described.

As in FIGS. 2A to 2F, FIGS. 3A to 3F are top views of the pixel portion, where potentials are applied to 25 (5×5) pixel electrodes.

Figure 3A:
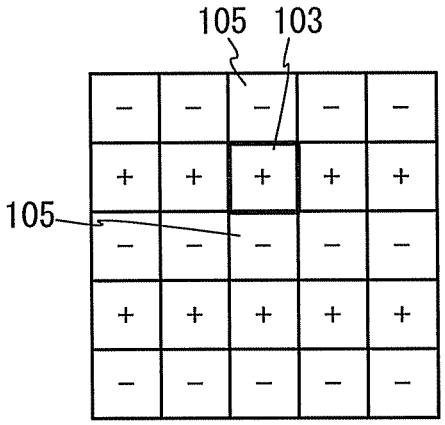
FIGS. 3A to 3F illustrate examples of a driving method of a display device.

In an example in FIG. 3A, a "+" potential is applied to the pixel electrodes 103 in one row and a "−" potential is applied to the pixel electrodes 105 in the upper and lower adjacent rows. When potentials whose polarities are different from each other are applied to pixel electrodes every other row so that pixels are initialized in this manner, electric fields are also generated in a direction parallel to the pixel electrodes. Thus, aggregation of particles can be reduced.

Figure 3B:
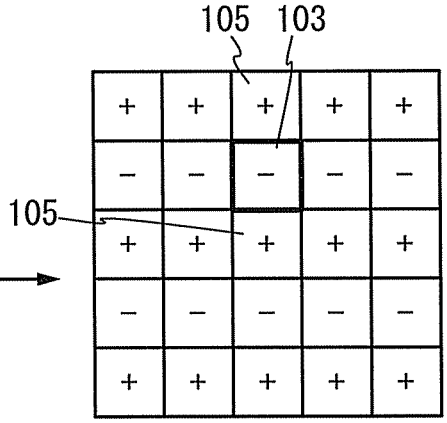

In addition, after the potentials are applied as in FIG. 3A, a "−" potential may be applied to the pixel electrodes 103 in the one row and a "+" potential may be applied to the pixel electrodes 105 in the upper and lower adjacent rows as in FIG. 3B. That is, the polarities of the potentials applied to the pixel electrodes are inverted. By such inversion of the polarities of applied potentials, the aggregation of the particles can be further reduced.

Figure 3C:
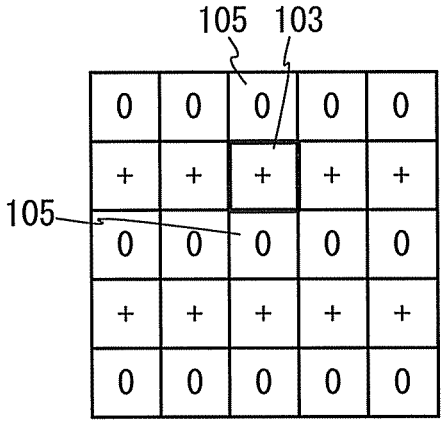

In an example in FIG. 3C, 0 V is applied instead of the "−" potential in FIG. 3A, so that electric fields are generated between the pixel electrodes 103 to which a "+" potential is applied and the pixel electrodes 105 to which 0 V is applied. Thus, electric fields are also generated in a direction parallel to the pixel electrodes, so that the aggregation of the particles can be reduced.

Figure 3D:
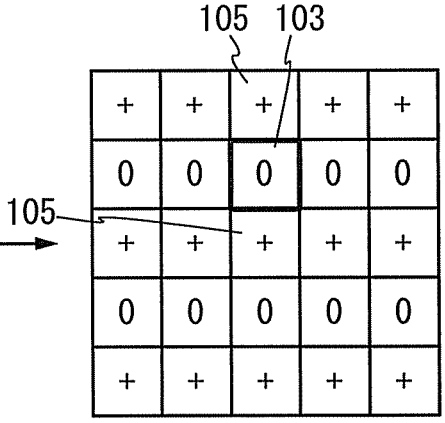

In addition, after the potentials are applied as in FIG. 3C, 0 V may be applied to the pixel electrode 103 in the one row and a "+" potential may be applied to the pixel electrodes 105 in the upper and lower adjacent rows as in FIG. 3D. That is, the levels of the potentials are inverted. By such inversion of 0 V and the "+" potential, the aggregation of the particles can be further reduced.

Figure 3E:
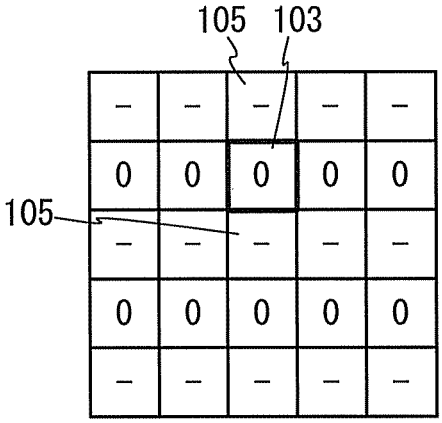

In an example in FIG. 3E, 0 V is applied instead of the "+" potential in FIG. 3A, so that electric fields are generated between the pixel electrodes 103 to which 0 V is applied and the pixel electrodes 105 to which a "−" potential is applied. Thus, electric fields are also generated in a direction parallel to the pixel electrodes, so that the aggregation of the particles can be reduced.

Figure 3F:
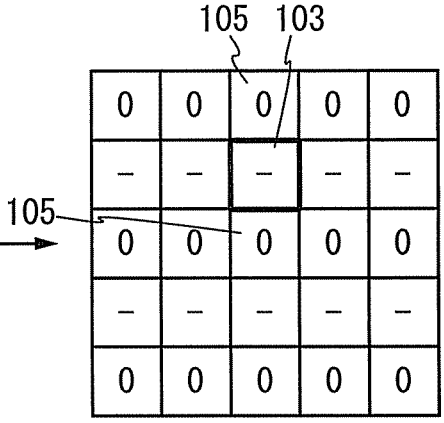
Figure 4A:
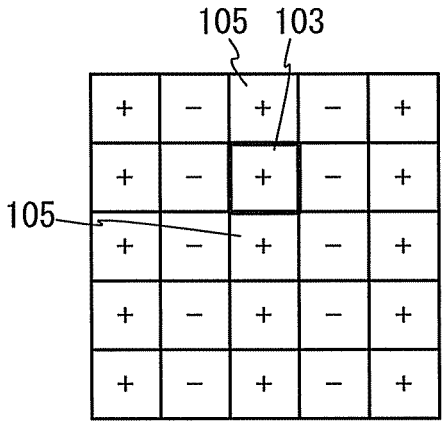
FIGS. 4A to 4F illustrate examples of a driving method of a display device.
Figure 4B:
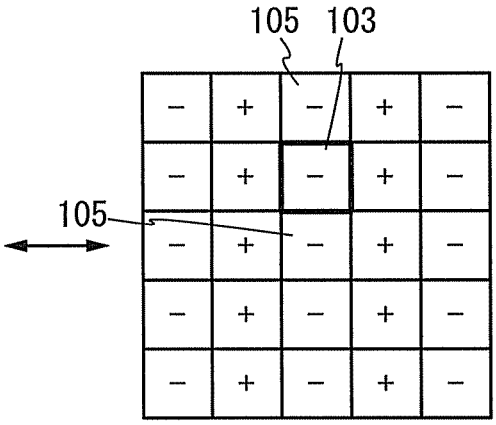
Figure 4C:
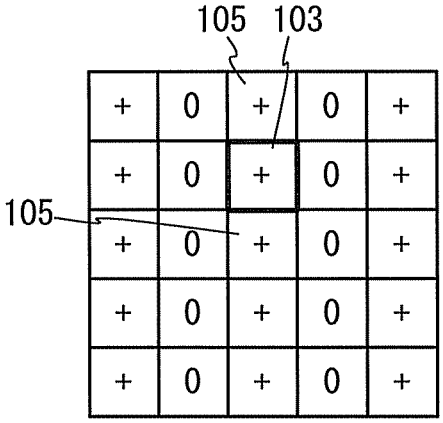
Figure 4D:
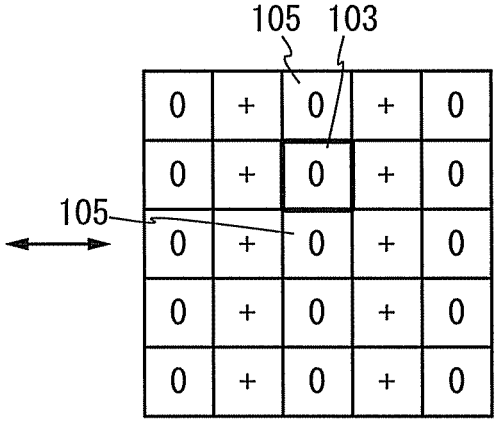
Figure 4E:
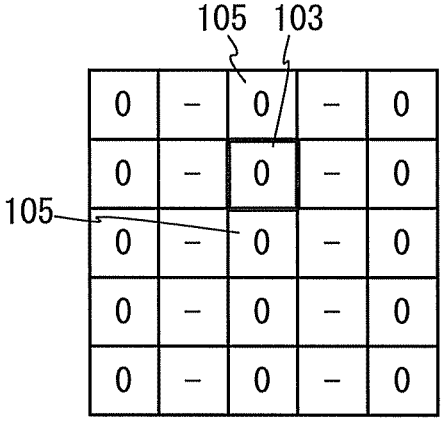
Figure 4F:
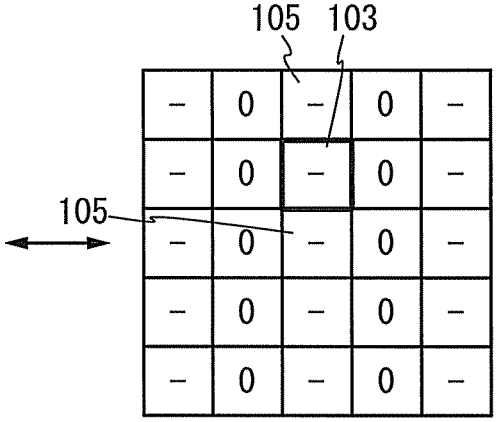
Figure 5A:
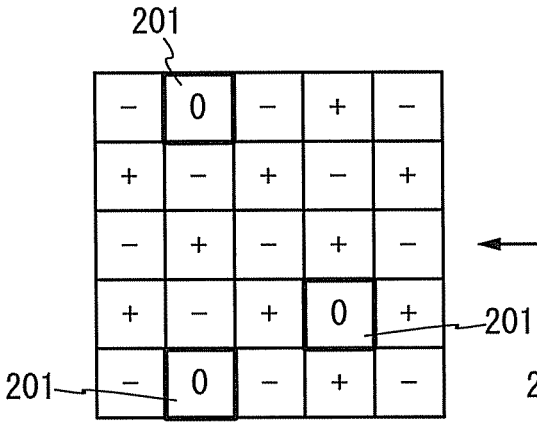
FIGS. 5A to 5F illustrate examples of a driving method of a display device.
Figure 5B:
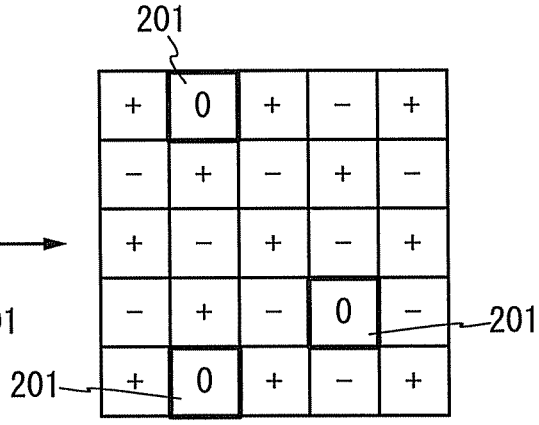
Figure 5C:
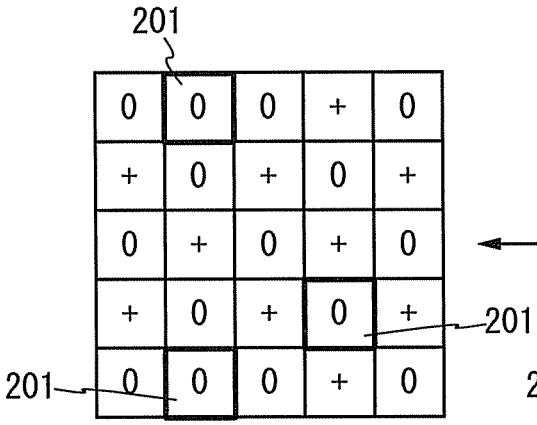
Figure 5D:
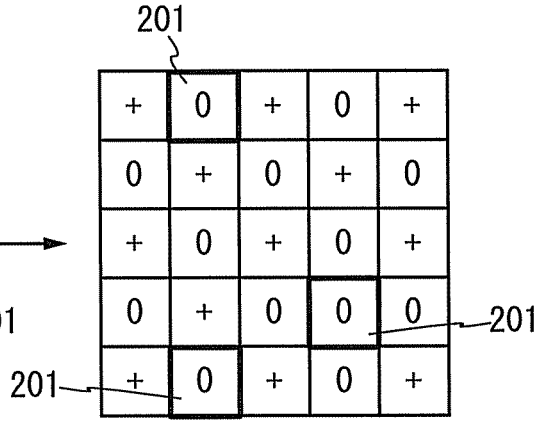
Figure 5E:
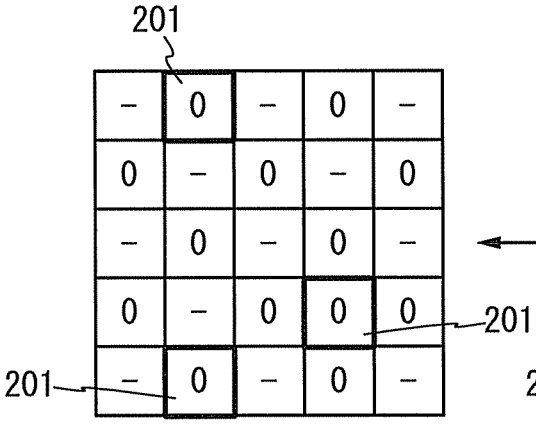
Figure 5F:
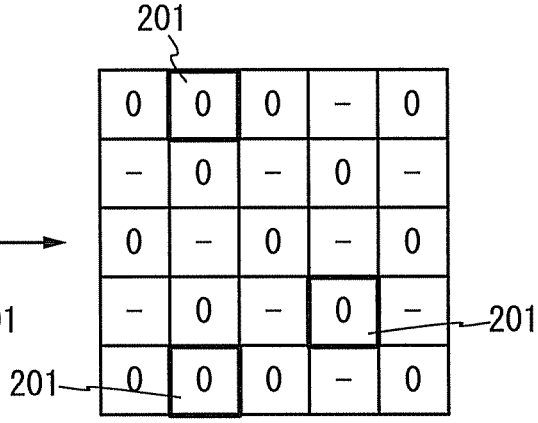

In addition, after the potentials are applied as in FIG. 3E, a "−" potential may be applied to the pixel electrodes 103 in the one row and 0 V may be applied to the pixel electrodes 105 in the upper and lower adjacent rows as in FIG. 3F. That is, the levels of the potentials are inverted. By such inversion of 0 V and the "−" potential, the aggregation of the particles can be further reduced.

Note that although different potentials are applied every other row in FIGS. 3A to 3F, different potentials may be applied every other column as in FIGS. 4A to 4F. In FIGS. 4A to 4F, potentials are applied to columns instead of the rows in FIGS. 3A to 3F. Also in FIGS. 4A to 4F, electric fields are generated in a direction parallel to the pixel electrodes, so that aggregation of particles can be reduced.

As described above, in FIGS. 3A to 3F and FIGS. 4A to 4F, initialization is performed in each row or in each column (in each line). Thus, in the case where inversion is performed, the inversion is also referred to as line inversion. The initialization may be performed by plural line inversions.

When video signals are input to pixel electrodes after pixels are initialized as described above, display in which afterimages are reduced can be performed.

This embodiment can be combined with any of the other embodiments as appropriate.

Embodiment 4

In this embodiment, a specific example of initialization of pixels that is different from the example in Embodiment 2 is described.

FIGS. 5A to 5F illustrate an example in which initialization is performed in each dot as in FIGS. 2A to 2F.

FIGS. 5A to 5F differ from FIGS. 2A to 2F in that initialization is not performed on pixel electrodes 201. That is, it is possible not to perform initialization on some of the pixel electrodes 201 in a pixel portion. Without the initialization, the number of applications of potentials for initialization can be reduced, so that power consumption can be reduced, for example.

Note that it is preferable that the pixel electrodes 201 on which initialization is not performed be not adjacent to each other because aggregation of particles can be reduced as much as possible even in the case where the initialization is not performed.

Further, it is possible not to perform initialization as described above also in the case where initialization is performed in each line as in FIGS. 3A to 3F or FIGS. 4A to 4F.

This embodiment can be combined with any of the other embodiments as appropriate.

Embodiment 5

In this embodiment, an example of initialization that is a combination of the above embodiments is described.

FIGS. 6A to 6F are flow charts of initialization of pixels and input of video signals.

Figure 6A:
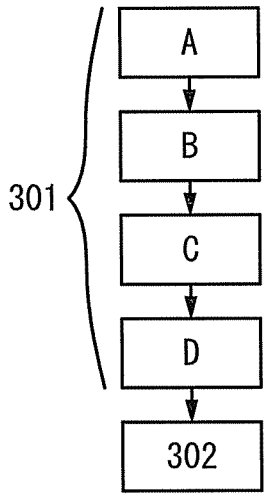
FIGS. 6A to 6F illustrate examples of a driving method of a display device.

In FIG. 6A, after initialization 301 of pixels, input 302 of video signals is performed. In FIG. 6A, steps A to D are performed as the initialization 301.

First, in the step A, the initialization in each dot as illustrated in FIG. 2A is performed. Then, in the step B, the initialization in each dot as illustrated in FIG. 2B is performed. That is, in the steps A and B, initialization by dot inversion is performed.

Then, in the step C, initialization is performed by input of a "+" potential to all the pixel electrodes (processing for displaying a white image on the entire screen). After that, in the step D, initialization is performed by input of a "−" potential to all the pixel electrodes (processing for displaying a black image on the entire screen). That is, initialization for displaying one image on the entire screen is performed. Note that the order of the steps C and D may be changed.

After such initialization, images are displayed by the input 302 of video signals. Note that a predetermined interval may be set between the steps and between the initialization 301 and the input 302 of video signals. In that case, the interval between the steps is preferably longer than the interval between the initialization 301 and the input 302 of video signals.

The initialization of pixels is performed by dot inversion in the steps A and B in this manner; thus, electric fields are also generated in a direction parallel to pixel electrodes, so that aggregation of particles can be reduced. Accordingly, display in which afterimages are reduced can be performed at the time of the input 302 of video signals.

Note that as the steps A and B, the initialization illustrated in FIGS. 2C and 2D in which 0 V is applied or the initialization in each line that is illustrated in FIGS. 3A to 3F and FIGS. 4A to 4F may be employed.

Figure 6B:
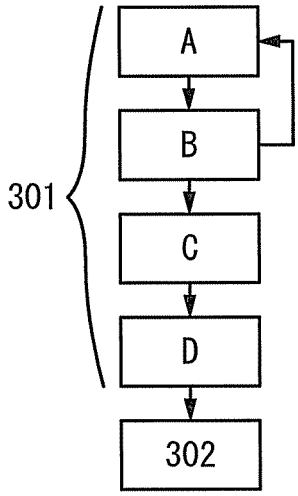

Alternatively, when the steps A and B are performed more than once as illustrated in FIG. 6B, the aggregation of the particles can be further reduced.

Figure 6C:
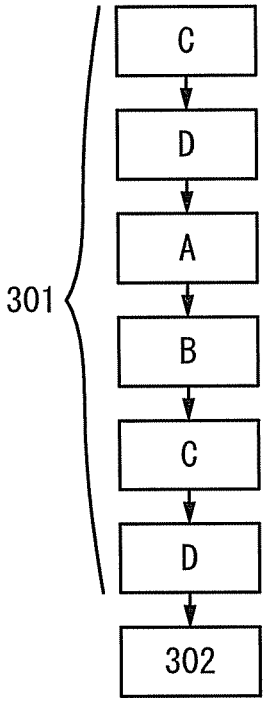

Alternatively, as illustrated in FIG. 6C, the initialization in the step C (for displaying a white image on the entire screen) and the initialization in the step D (for displaying a black image on the entire screen) may be performed first.

Figure 6D:
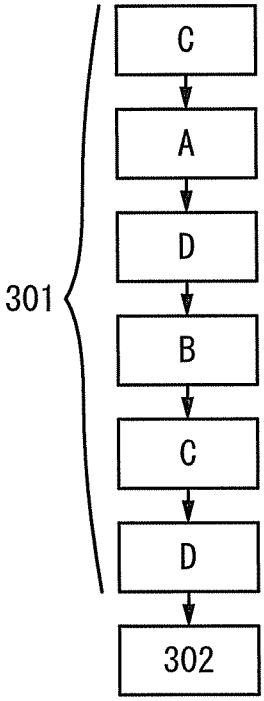

Alternatively, as illustrated in FIG. 6D, the order of the initializations in FIG. 6C may be changed. In other words, the step C, the step A, the step D, and the step B may be sequentially performed so that the initialization by inversion and the initialization for displaying a white image (a black image) on the entire screen are mixed.

Figure 6E:
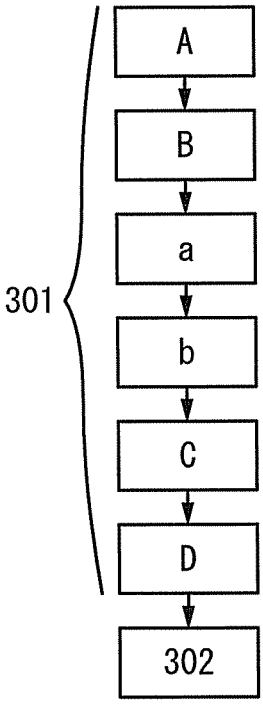

Further, in FIG. 6E, dot inversion is performed in the steps A and B and line inversion is performed in steps a and b. In this manner, initialization by dot inversion and initialization by line inversion may be used in combination.

Figure 6F:
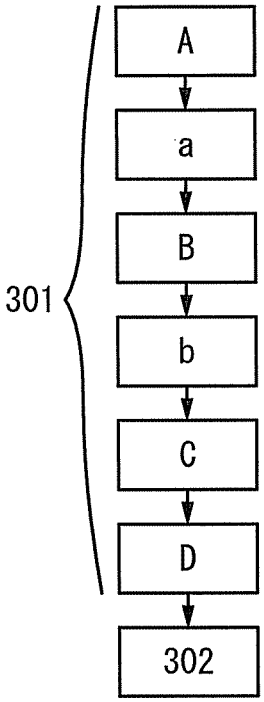

Alternatively, as illustrated in FIG. 6F, the order of the initializations in FIG. 6E may be changed. In other words, the step A, the step a, the step B, and the step b may be sequentially performed so that the initialization by dot inversion and the initialization by line inversion are mixed.

With an appropriate combination of the initializations, display in which afterimages are reduced can be performed at the time of the input 302 of video signals.

This embodiment can be combined with any of the other embodiments as appropriate.

Embodiment 6

In this embodiment, structure examples of display devices are described.

Figure 7A:
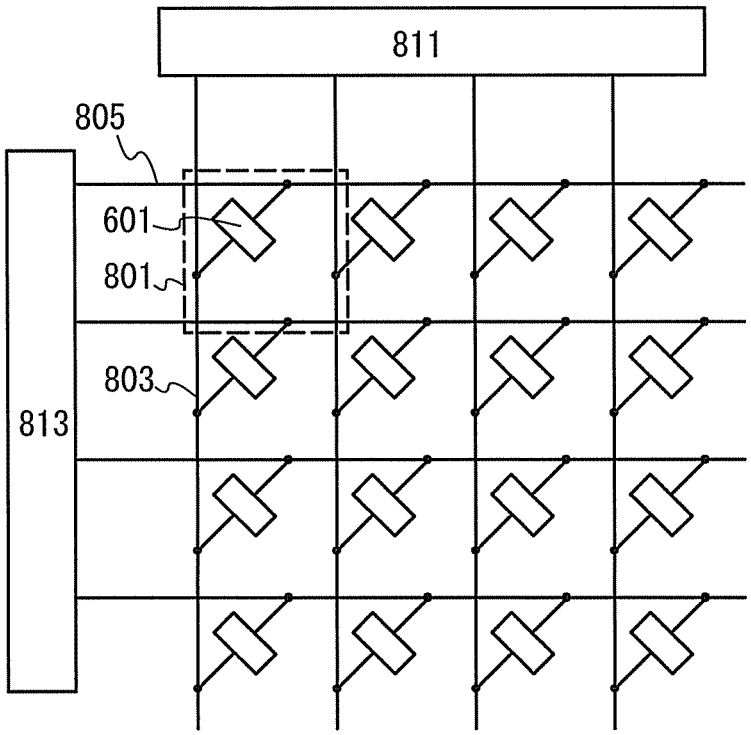
FIGS. 7A and 7B illustrate examples of structures of display devices.
Figure 7B:
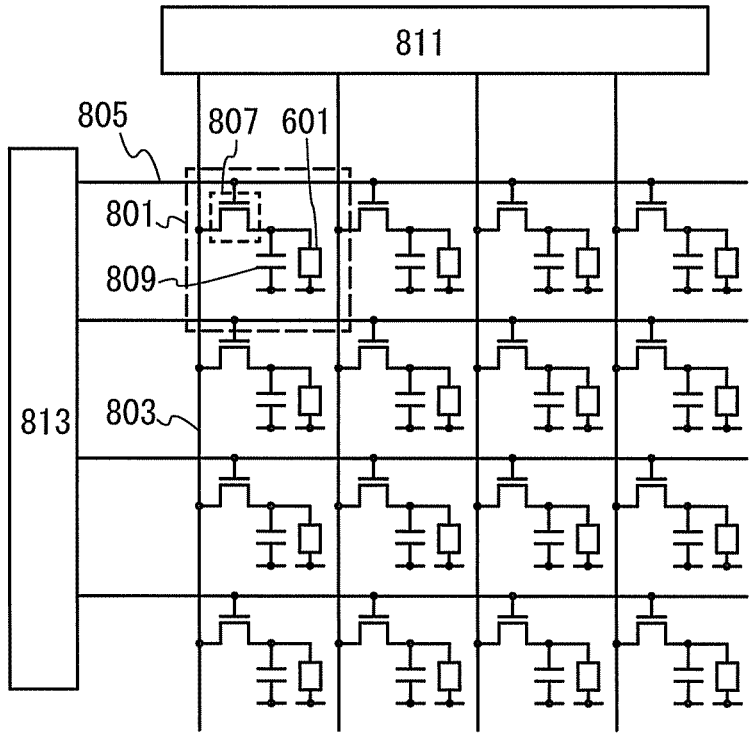

FIGS. 7A and 7B each illustrate examples of pixel circuits and driver circuits. FIG. 7A illustrates a passive-matrix display device, and FIG. 7B illustrates an active-matrix display device. Each display device includes display elements 601 in a plurality of pixels 801 arranged in matrix.

The structure of the display element that is described in the above embodiment can be used as the structure of the display element 601 and a driving method.

In the passive-matrix display device illustrated in FIG. 7A, the pixel 801 includes a plurality of crossed wirings 803 and 805 and the display element 601 which is electrically connected between the crossed wirings 803 and 805. In addition, the wiring 803 is electrically connected to a driver circuit 811, and the wiring 805 is electrically connected to a driver circuit 813. Further, the display element 601 expresses gradation in accordance with potentials input from the driver circuit 811 and the driver circuit 813.

In the active-matrix display device illustrated in FIG. 7B, the pixel 801 includes the plurality of crossed wirings 803 and 805, a transistor 807, the display element 601, and a capacitor 809. A gate of the transistor 807 is electrically connected to the wiring 805. One of a source and a drain of the transistor 807 is electrically connected to the wiring 803. The other of the source and the drain of the transistor 807 is electrically connected to the display element 601 and the capacitor 809. In addition, the wiring 803 is electrically connected to the driver circuit 811, and the wiring 805 is electrically connected to the driver circuit 813. On and off of the transistor 807 are controlled in accordance with a potential input from the driver circuit 813. Further, the display element 601 expresses gradation in accordance with a potential input from the driver circuit 811 at the time when the transistor 807 is on. Note that the capacitor 809 has a function of holding voltage applied to the display element 601.

Next, cross-sectional structures of pixel portions are described.

Figure 8A:
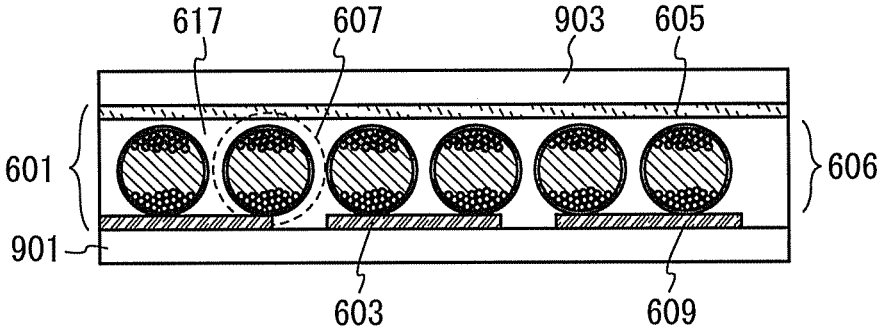
FIGS. 8A and 8B illustrate examples of structures of display devices.

FIG. 8A illustrates a cross-sectional structure of the passive-matrix display device. The display element 601 is provided between a substrate 901 and a counter substrate 903. The plurality of wirings 803 are the pixel electrodes 603 and 609 on the substrate 901 side extended in a direction perpendicular to paper. The plurality of wirings 805 are the counter electrode 605 on the counter substrate 903 side extended in a direction parallel to the paper. Note that although FIG. 8A illustrates only one counter electrode 605, the plurality of counter electrodes 605 are provided in the direction parallel to the paper. That is, the display elements 601 are formed in portions where the plurality of wirings 803 and the plurality of wirings 805 intersect with each other.

Figure 8B:
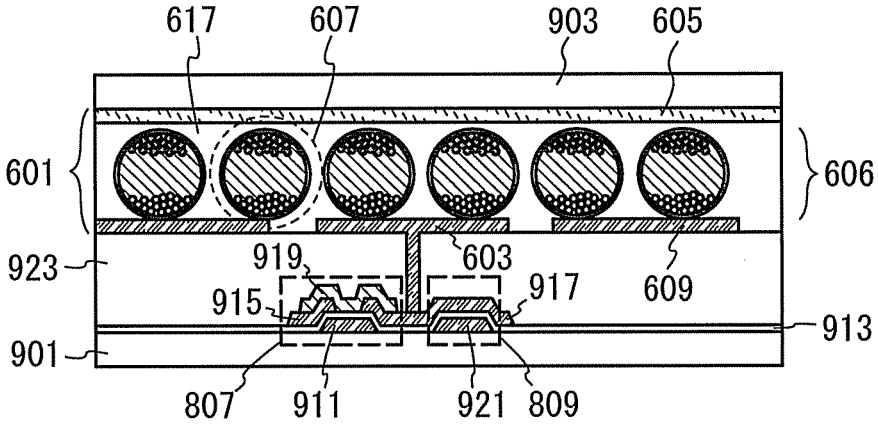

FIG. 8B illustrates a cross-sectional structure of the active-matrix display device. A layer containing the transistor 807 and the capacitor 809 and the display element 601 formed over the layer are provided between the substrate 901 and the counter substrate 903. In addition, the transistor 807 and the capacitor 809 are electrically connected to the pixel electrode 603. Note that although not illustrated in FIG. 8B, a transistor and a capacitor are electrically connected to the pixel electrode 609.

As the substrate 901 and the counter substrate 903, a glass substrate, a resin substrate, a semiconductor substrate, a metal substrate, or any of the substrates provided with an insulating film such as a nitride film or an oxide film can be used as appropriate.

The transistor 807 is a bottom-gate thin film transistor, which includes an electrode 911, an insulating film 913, an electrode 915, an electrode 917, and a semiconductor layer 919. Here, the electrode 911 is a gate electrode. In addition, the insulating film 913 is a gate insulating film. Further, one of the electrode 915 and the electrode 917 functions as a source electrode, and the other of the electrode 915 and the electrode 917 functions as a drain electrode.

The capacitor 809 includes an electrode 921, the electrode 917, and the insulating film 913. Here, the electrode 921 is a lower electrode of the capacitor 809 and a conductive layer that is formed in the same layer as the electrode 911 (the gate electrode). In addition, the insulating film 913 functions as the gate insulating film and a dielectric of the capacitor 809. Further, the electrode 917 is a conductive layer extended over the insulating film 913 and functions as one of the source electrode and the drain electrode and an upper electrode of the capacitor 809.

The electrode 911, the electrode 921, the electrode 915, and the electrode 917 are each formed to have a single-layer structure or a layered structure of a metal material such as molybdenum, titanium, tantalum, tungsten, aluminum, copper, neodymium, or scandium or an alloy material containing the metal material as a main component.

The insulating film 913 is formed as a single layer or stacked layers of a silicon oxide film, a silicon nitride film, or the like.

The semiconductor layer 919 can be formed using an amorphous semiconductor, a polycrystalline semiconductor, a single crystal semiconductor, or a microcrystalline semiconductor. In addition, as the material of the semiconductor, silicon, germanium, an organic semiconductor, an oxide semiconductor, or the like can be used. Further, either a p-channel transistor or an n-channel transistor may be used. Note that either a channel-etched transistor or a channel-stop transistor may be used, and a top-gate structure may be employed. Furthermore, a transistor using a semiconductor substrate (also referred to as a bulk transistor) may be used instead of a thin film transistor.

The transistor 807 can have a variety of structures such as a single-drain structure, an LDD (lightly doped drain) structure, and a gate-overlap drain structure.

Further, an insulating film 923 is formed between the transistor 807 and the capacitor 809, and the pixel electrode 603.

The insulating film 923 has a single-layer structure or a layered structure of an inorganic material such as silicon oxide or silicon nitride, an organic material such as a polyimide resin, a polyamide resin, a benzocyclobutene resin, an acrylic resin, or an epoxy resin, a siloxane material, or the like.

Furthermore, a structure in which a color filter (CF) or a black matrix (BM) is provided on the substrate 901 side or the counter substrate 903 side may be employed as appropriate, for example. Note that CFs or BMs may be provided on both the substrate 901 side and the counter substrate 903 side.

This embodiment can be combined with any of the other embodiments as appropriate.

Embodiment 7

In this embodiment, examples of methods for manufacturing display devices are described. Note that the structures described in the above embodiment can be used as appropriate as materials, structures, and the like.

First, a method for manufacturing the passive-matrix display device is described with reference to FIG. 8A.

Wirings which serve as the pixel electrodes 603 and 609 are formed over the substrate 901 so as to extend in a direction perpendicular to paper. Here, a conductive film which serves as the pixel electrodes is deposited, and then, is processed into the pixel electrodes 603 and 609 by etching or the like.

Next, the charged layer 606 (also referred to as the layer including a charged substance) is formed over the pixel electrodes 603 and 609. For example, the resin 617 where the microcapsules 607 are dispersed and fixed is provided over the pixel electrodes 603 and 609.

Then, a wiring which serves as the counter electrode 605 is formed over the resin 617 (the charged layer 606) so as to extend in a direction parallel to the paper. Note that the resin 617 over which the counter electrode 605 is formed in advance may be provided over the pixel electrodes 603 and 609.

Next, the counter substrate 903 is provided over the counter electrode 605. The counter substrate 903 is attached to the substrate 901 with a sealant.

Note that the counter substrate 903 on which the counter electrode 605 is formed may be attached to the substrate 901 with a sealant.

In the case where electronic liquid powder is used instead of the microcapsules, a polymer micro-particle which is positively charged and colored with a certain color and a polymer micro-particle which is negatively charged and colored with a different color may be provided between the pixel electrode 603 and the counter electrode 605. In this manner, the display element can be formed by the different method.

Thus, the passive-matrix display device can be manufactured.

Next, a method for manufacturing the active-matrix display device is described with reference to FIG. 8B. Description of steps that are similar to the steps in the passive-matrix display device is omitted.

The transistor 807 and the capacitor 809 are formed over the substrate 901.

The insulating film 923 is formed over the transistor 807 and the capacitor 809.

The pixel electrodes 603 and 609 are formed over the insulating film 923. Here, a conductive film which serves as the pixel electrodes is deposited, and then, is processed into the pixel electrodes 603 and 609 by etching or the like.

Next, the charged layer 606 (also referred to as the layer including a charged substance) is formed over the pixel electrodes 603 and 609. For example, the resin 617 where the microcapsules 607 are dispersed and fixed is provided over the pixel electrodes 603 and 609.

Then, the counter electrode 605 is formed over the resin 617 (the charged layer 606). Note that the resin 617 over which the counter electrode 605 is formed in advance may be provided over the pixel electrodes 603 and 609.

Next, the counter substrate 903 is provided over the counter electrode 605. The counter substrate 903 is attached to the substrate 901 with a sealant.

Note that the counter substrate 903 on which the counter electrode 605 is formed may be attached to the substrate 901 with a sealant.

Thus, the active-matrix display device can be manufactured.

This embodiment can be combined with any of the other embodiments as appropriate.

Embodiment 8

In this embodiment, an example of a method for manufacturing a display device that is different from the example in Embodiment 7 is described. Note that the structures described in the above embodiment can be used as appropriate as materials, structures, and the like.

Figure 9A:
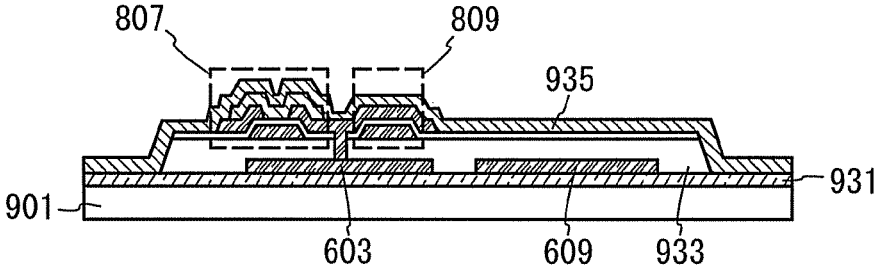
FIGS. 9A to 9E illustrate an example of a method for manufacturing a display device.

First, a separation layer 931 is formed over the substrate 901 (see FIG. 9A).

The separation layer 931 can be formed to have a single-layer structure or a layered structure of a material such as tungsten, molybdenum, titanium, tantalum, niobium, nickel, cobalt, zirconium, zinc, ruthenium, rhodium, palladium, osmium, iridium, or silicon. Alternatively, the separation layer 931 may be formed using an alloy material containing such an element as a main component, or a compound material containing such an element as a main component. The separation layer 931 can be formed to a thickness of 30 to 200 nm with the use of such a material by sputtering, plasma-enhanced CVD, coating, printing, or the like.

In addition, an insulating film (e.g., a silicon nitride film or a silicon oxide film) which serves as a buffer layer may be formed over the separation layer 931. Provision of the insulating film facilitates separation along a surface of the separation layer 931 in a later separation step.

Next, the pixel electrodes 603 and 609 are formed over the separation layer 931. Here, a conductive film which serves as the pixel electrodes is deposited, and then, is processed into the pixel electrodes 603 and 609 by etching or the like.

An insulating film 933 is formed over the pixel electrodes 603 and 609. The insulating film 933 has a single-layer structure or a layered structure of an inorganic material such as silicon oxide or silicon nitride, an organic material such as a polyimide resin, a polyamide resin, a benzocyclobutene resin, an acrylic resin, or an epoxy resin, a siloxane material, or the like. The insulating film 933 can be formed using such a material by CVD, sputtering, an SOG method, a droplet discharge method, screen printing, or the like.

Then, the transistor 807 and the capacitor 809 are formed over the insulating film 933. In addition, the transistor 807 and the capacitor 809 are electrically connected to the pixel electrode 603. Note that a transistor and a capacitor which are electrically connected to the pixel electrode 609 are not illustrated in FIG. 9A.

After that, parts of the insulating film 933 that are provided at ends of the substrate 901 are removed by etching or the like. Then, an insulating film 935 is formed so as to cover the transistor 807 and the capacitor 809. The insulating film 935 functions as a barrier layer and can be formed using a nitrogen-containing layer (a layer containing silicon nitride, silicon nitride oxide, silicon oxynitride, or the like).

Figure 9B:
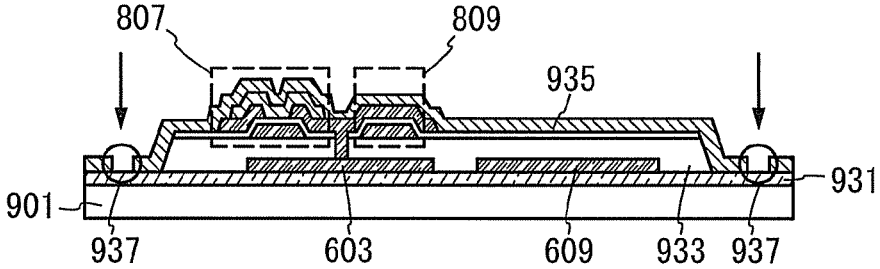
Figure 9C:
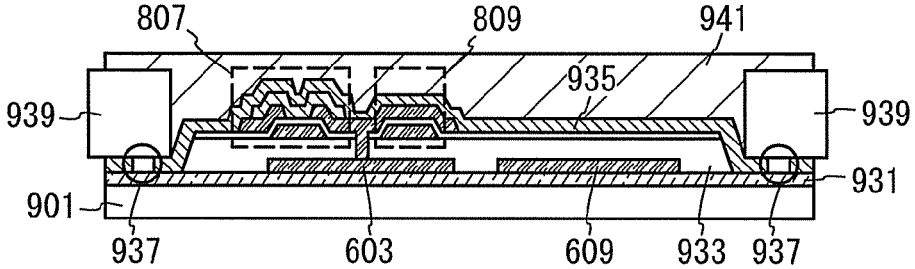

Next, grooves 937 are formed by irradiation of the insulating film 935 with laser beams (see FIG. 9B). Then, a separate film 939 is provided so as to cover at least the grooves 937 (see FIG. 9C).

After that, a first organic resin 941 is formed over the insulating film 935. Provision of the separate film 939 can prevent the first organic resin 941 from entering the grooves 937 and being bonded to the separation layer 931. Note that the organic resin 941 functions as a substrate (also referred to as a support substrate).

Figure 9D:
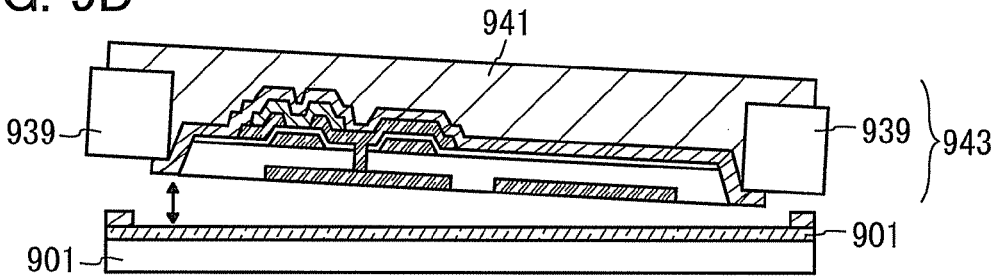

Then, an element layer 943 is separated from the substrate 901 along the surface of the separation layer 931 from the grooves 937 (see FIG. 9D). The separate film 939 is eliminated after the separation.

Figure 9E:
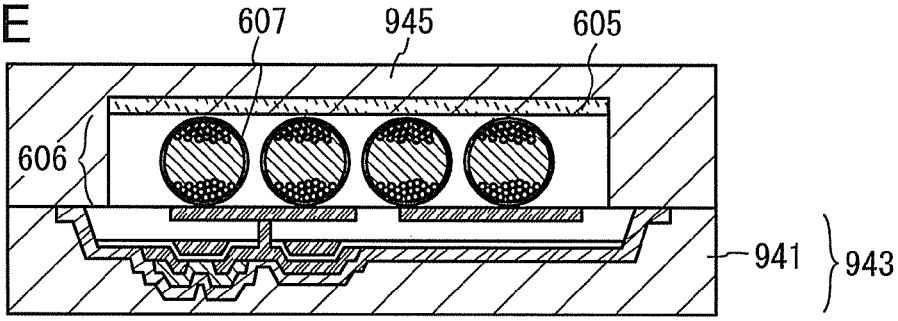

Next, as described in another embodiment, the charged layer 606 (the layer including a charged substance) is formed over the pixel electrodes 603 and 609 (see FIG. 9E). Note that the separated element layer 943 is used while being upside down.

Then, a second organic resin 945 on which the counter electrode 605 is formed is provided over the charged layer 606. After that, the first organic resin 941 and the second organic resin 945 are bonded to each other by heat treatment. The second organic resin 945 functions as a counter substrate.

Note that the formation order of the charged layer 606, the counter electrode 605, and the counter substrate may be similar to the formation order in the above embodiment.

A thermosetting resin such as an epoxy resin, an unsaturated polyester resin, a polyimide resin, a bismaleimide-triazine resin, or a cyanate resin can be used as the first organic resin 941 and the second organic resin 945. Alternatively, a thermoplastic resin such as a polyphenylene oxide resin, a polyetherimide resin, or a fluorine resin may be used. A flexible display device can be manufactured using an organic resin.

Note that a passive-matrix display device can be manufactured by applying the manufacturing method.

This embodiment can be combined with any of the other embodiments as appropriate.

Embodiment 9

In this embodiment, examples of electronic devices are described.

Figure 10A:
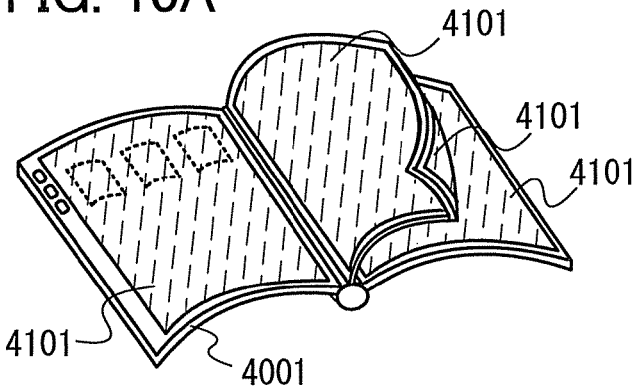
FIGS. 10A to 10F illustrate examples of electronic devices.
Figure 10D:
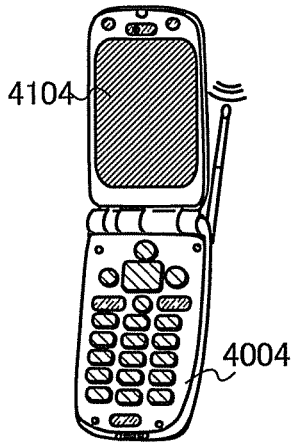
Figure 10B:
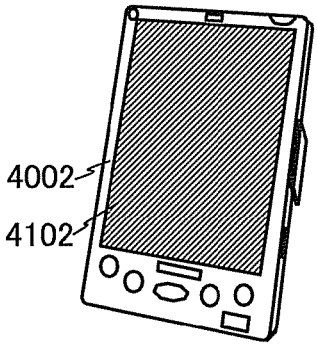

FIGS. 10A and 10B each illustrate electronic paper (also referred to as an e-book reader, an electronic book, or the like). In FIGS. 10A and 10B, the display device disclosed in this specification can be used in a display portion 4101 in a main body 4001 and a display portion 4102 in a main body 4002.

Figure 10E:
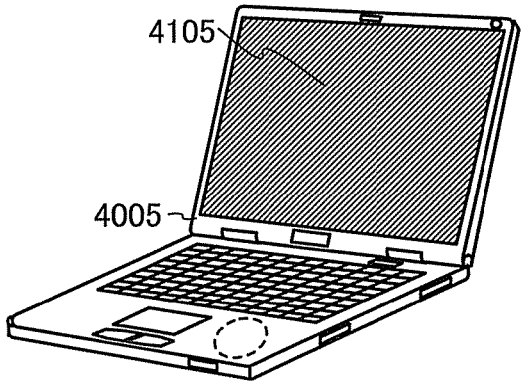
Figure 10C:
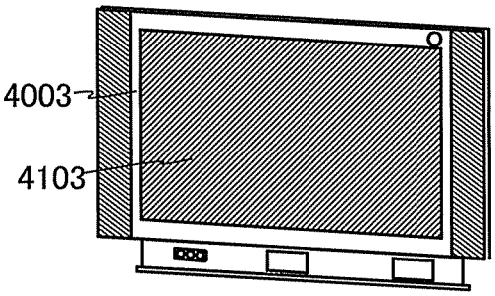
Figure 10F:
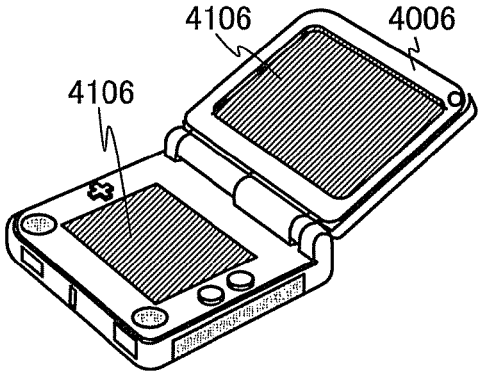
Figure 11:
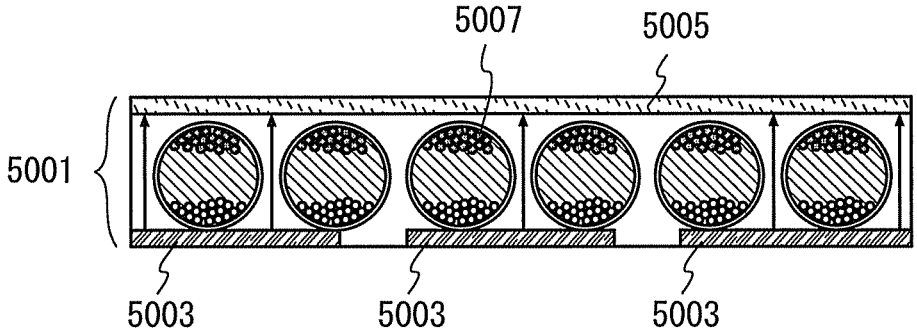
FIG. 11 illustrates an example of a conventional display device.

Further, without limitation to the electronic paper, the display device disclosed in this specification can be used in display portions 4103 to 4106 in main bodies 4003 to 4006 in electronic devices such as a television in FIG. 10C, a cellular phone in FIG. 10D, a personal computer in FIG. 10E, and a game machine in FIG. 10F.

This embodiment can be combined with any of the other embodiments as appropriate.

This application is based on Japanese Patent Application serial No. 2010-144865 filed with Japan Patent Office on Jun. 25, 2010, the entire contents of which are hereby incorporated by reference.

What is claimed is:

1. A method for driving a display device comprising:

a pixel portion, the pixel portion comprising:

a plurality of pixels arranged in matrix, wherein each of the plurality of pixels includes a pixel electrode over a first substrate, wherein the plurality of pixels include a counter electrode which is on a second substrate in common, wherein the counter electrode faces the pixel electrode in each of the plurality of pixels with a layer which includes a plurality of microcapsules interposed therebetween, wherein each of the plurality of microcapsules includes liquid and a charged substance which are encapsulated in a film, wherein the plurality of pixels include a plurality of first pixels and a plurality of second pixels, and wherein the plurality of second pixels are not adjacent to each other, the method for driving the display device, comprising steps of:

performing initialization on the plurality of first pixels by applying a first potential whose polarity is positive with respect to a reference potential to the pixel electrode in one of the plurality of first pixels while applying a second potential whose polarity is negative with respect to the reference potential to the pixel electrodes in all of the first pixels adjacent to the one of the plurality of first pixels, and then inverting polarity of the first potential and the second potential; and inputting video signals to the plurality of pixels after the initialization is performed, and wherein the initialization is not performed on the plurality of second pixels before the step of inputting the video signals.

2. The method for driving the display device according to claim 1, wherein the reference potential is applied to the counter electrode during the initialization.

3. The method for driving the display device according to claim 1, further comprising:

transistors electrically connected to respective pixel electrodes, wherein the transistors are provided over the first substrate.

4. The method for driving the display device according to claim 1, wherein electric fields are generated between the pixel electrode in the one of the plurality of first pixels and the pixel electrodes in all of the first pixels adjacent to the one of the plurality of first pixels during the initialization.

5. The method for driving the display device according to claim 1, wherein potential of the pixel electrodes in the plurality of second pixels do not change during the initialization.

6. A method for driving a display device comprising:

a pixel portion, the pixel portion comprising:

a plurality of pixels arranged in matrix, wherein each of the plurality of pixels includes a pixel electrode over a first substrate, wherein the plurality of pixels include a counter electrode which is on a second substrate in common, wherein the counter electrode faces the pixel electrode in each of the plurality of pixels with a layer which includes a plurality of microcapsules interposed therebetween, wherein each of the plurality of microcapsules includes liquid and a charged substance encapsulated in a film, wherein the plurality of pixels include a plurality of first pixels and a plurality of second pixels, and wherein the plurality of second pixels are not adjacent to each other, the method for driving the display device, comprising steps of:

performing initialization on the plurality of first pixels, the initialization comprising steps of:

applying a first potential to the pixel electrode in one of the plurality of first pixels while applying a second potential different from the first potential to the pixel electrodes in all of the first pixels adjacent to the one of the plurality first pixels, and then applying the second potential to the pixel electrode in the one of the plurality of first pixels while applying the first potential to the pixel electrodes in all of the first pixels adjacent to the one of the plurality of first pixels; and inputting video signals to the plurality of pixels after the initialization is performed, wherein the initialization is not performed on the plurality of second pixels before the step of inputting the video signals.

7. The method for driving the display device according to claim 6, wherein the second potential which is a reference potential is applied to the counter electrode during the initialization.

8. The method for driving the display device according to claim 6, further comprising:

transistors electrically connected to respective pixel electrodes, wherein the transistors are provided over the first substrate.

9. The method for driving the display device according to claim 6, wherein electric fields are generated between the pixel electrode in the one of the plurality of first pixels and the pixel electrodes in all of the first pixels adjacent to the one of the plurality of first pixels during the initialization.

10. The method for driving the display device according to claim 6, wherein potential of the pixel electrodes in the plurality of second pixels do not change during the initialization.

11. A method for driving a display device comprising:

a pixel portion, the pixel portion comprising:

a plurality of pixels arranged in matrix, wherein each of the plurality of pixels includes a pixel electrode over a first substrate, wherein the plurality of pixels include a counter electrode which is on a second substrate in common, wherein the counter electrode faces the pixel electrode in each of the plurality of pixels with a layer which includes a plurality of microcapsules interposed therebetween, wherein the plurality of microcapsules each includes liquid and a charged substance encapsulated in a film, wherein the plurality of pixels include a plurality of first pixels and a plurality of second pixels, and wherein the plurality of second pixels are not adjacent to each other, the method for driving the display device, comprising steps of:

performing initialization on the plurality of first pixels, the initialization comprising steps of:

performing a first step in which a first potential whose polarity is positive with respect to a reference potential is applied to the pixel electrode in one of the plurality of first pixels while a second potential whose polarity is negative with respect to the reference potential is applied to the pixel electrodes in all of the first pixels adjacent to the one of the plurality of first pixels, and then inverting polarity of the first potential and the second potential;

performing a second step in which a third potential whose polarity is positive with respect to the reference potential is applied to the pixel electrodes in the first pixels in a first line while a fourth potential whose polarity is positive with respect to the reference potential is applied to the pixel electrodes in the first pixels in a second line adjacent to the first line, and then inverting polarity of the third potential and the forth potential, and inputting video signals to the plurality of pixels after the initialization is performed, wherein the initialization is not performed on the plurality of second pixels before the step of inputting the video signals.

12. The method for driving the display device according to claim 11, further comprising:

transistors electrically connected to respective pixel electrodes, wherein the transistors are provided over the first substrate.

13. The method for driving the display device according to claim 11, wherein electric fields are generated between the pixel electrode in the one of the plurality of first pixels and the pixel electrodes in all of the first pixels adjacent to the one of the plurality of first pixels in the first step of the initialization, and wherein electric fields are generated between the pixel electrodes in the first pixels in the first line and the pixel electrodes in the first pixels in the second line during the second step.

14. The method for driving the display device according to claim 11, wherein potential of the pixel electrodes in the plurality of second pixels do not change during the initialization.

15. A display device comprising:

a pixel portion, the pixel portion comprising:

a plurality of pixels arranged in matrix, wherein each of the plurality of pixels includes a pixel electrode over a first substrate, wherein the plurality of pixels include a counter electrode which is on a second substrate in common, wherein the counter electrode faces the pixel electrode in each of the plurality of pixels with a layer which includes a plurality of microcapsules interposed therebetween, wherein each of the plurality of microcapsules includes liquid and a charged substance which are encapsulated in a film, wherein the plurality of pixels include a plurality of first pixels and a plurality of second pixels, and wherein the plurality of second pixels are not adjacent to each other, wherein the display device is configured to perform initialization on the plurality of first pixels by applying a first potential whose polarity is positive with respect to a reference potential to the pixel electrode in one of the plurality of first pixels while applying a second potential whose polarity is negative with respect to the reference potential to the pixel electrodes in all of the first pixels adjacent to the one of the plurality of first pixels and not to perform the initialization on the plurality of second pixels, and wherein the display device is configured to supply a video signal to the plurality of pixels after the initialization.

16. The display device according to claim 15, wherein the display device is configured to apply the reference potential to the counter electrode during the initialization.

17. The display device according to claim 15, further comprising:

transistors electrically connected to respective pixel electrodes, wherein the transistors are provided over the first substrate.

18. A display device comprising:

a pixel portion, the pixel portion comprising:

a plurality of pixels arranged in matrix, wherein each of the plurality of pixels includes a pixel electrode over a first substrate, wherein the plurality of pixels include a counter electrode which is on a second substrate in common, wherein the counter electrode faces the pixel electrode in each of the plurality of pixels with a layer which includes a plurality of microcapsules interposed therebetween, wherein each of the plurality of microcapsules includes liquid and a charged substance encapsulated in a film, wherein the plurality of pixels include a plurality of first pixels and a plurality of second pixels, and wherein the plurality of second pixels are not adjacent to each other, wherein the display device is configured to perform initialization on the plurality of first pixels by applying a first potential to one of the plurality of the pixel electrodes while applying a second potential different from the first potential to the pixel electrodes in all of the first pixels adjacent to the one of the plurality of first pixels, and then applying the second potential to the one of the plurality of the pixel electrodes and the first potential to the pixel electrodes in all of the first pixels adjacent to the one of the plurality of first pixels and not to perform the initialization on the plurality of second pixels, and wherein the display device is configured to supply a video signal to the plurality of pixels after the initialization.

19. The display device according to claim 18, wherein the display device is configured to apply the second potential which is a reference potential to the counter electrode during the initialization.

20. The display device according to claim 18, further comprising:

transistors electrically connected to respective pixel electrodes, wherein the transistors are provided over the first substrate.

* * * * *